US008469221B2

(12) United States Patent
Ullmann et al.

(10) Patent No.: US 8,469,221 B2
(45) Date of Patent: Jun. 25, 2013

(54) FLOATING MULTI-CHAMBERED INSERT FOR LIQUID CONTAINERS

(75) Inventors: Bernd Ullmann, Bonn (DE); Ralf Lieberz, Alfter (DE)

(73) Assignee: Ball Packaging Europe GmbH, Ratingen (DE)

( * ) Notice: Subject to any disclaimer, the term of this patent is extended or adjusted under 35 U.S.C. 154(b) by 1354 days.

(21) Appl. No.: 11/632,008

(22) PCT Filed: Jun. 28, 2005

(86) PCT No.: PCT/EP2005/006955

§ 371 (c)(1),
(2), (4) Date: Jun. 10, 2008

(87) PCT Pub. No.: WO2006/005440

PCT Pub. Date: Jan. 19, 2006

(65) Prior Publication Data

US 2008/0245801 A1 Oct. 9, 2008

(30) Foreign Application Priority Data

Jul. 9, 2004 (EP) ..... 04016274

(51) Int. Cl.
*B65D 25/04* (2006.01)
*B65D 39/00* (2006.01)

(52) U.S. Cl.
USPC ..... 220/506; 220/523; 220/23.87

(58) Field of Classification Search
USPC ..... 220/792, 506, 526, 23.87, 23.89, 220/523; 215/6
See application file for complete search history.

(56) References Cited

U.S. PATENT DOCUMENTS 1,567,050 A 12/1925 Grieshaber et al.
2,615,448 A * 10/1952 Fields ..... 604/416

(Continued)

FOREIGN PATENT DOCUMENTS

CA 2 380 030 10/2002
DE 297 16 262 U 12/1997

(Continued)

OTHER PUBLICATIONS

ISR, Dec. 23, 2005.

(Continued)

*Primary Examiner* — Mickey Yu
*Assistant Examiner* — Niki Eloshway
(74) *Attorney, Agent, or Firm* — Sheridan Ross P.C.

(57) ABSTRACT

The invention relates to an insert for a pressurized liquid container, comprising a product chamber (9), for holding an additive and a pressure chamber (11), with at least one opening to the exterior of small diameter and a lid (3) for sealing both chambers (9,11), whereby the geometry of the pressure and product chambers are selected such that said opening lies above the fluid level on floating and viewed from the side of the lid, the product chamber (9) is surrounded on the lid side by the pressure chamber (11), characterized in that the lid (3) comprises sealing means (4,5), engaging with each of the side walls (1,2*c*) of both chambers (9,11) at a uniform separation from each wall end and a separation a, between a sealing line (5) of the lid (3) on the lateral wall (2*c*) of the pressure chamber and the end of said wall, is greater than a separation b between the or the furthest sealing line (4*b*) of the lid on the side wall (1) of the product chamber (9) and a line in the region of the upper end of said product chamber side wall (1), from which the seal no longer touches.

14 Claims, 2 Drawing Sheets

U.S. PATENT DOCUMENTS

| | | | | |
|---|---|---|---|---|
| 3,144,020 | A | | 8/1964 | Zingale |
| 3,449,134 | A | | 6/1969 | Leasure et al. |
| 3,730,374 | A | * | 5/1973 | Picciano et al. ..... 220/592.15 |
| 4,319,614 | A | * | 3/1982 | Boice ..... 141/381 |
| 4,618,444 | A | * | 10/1986 | Hudson et al. ..... 8/111 |
| 4,627,986 | A | | 12/1986 | Bardsley et al. |
| 4,720,351 | A | * | 1/1988 | Flynn et al. ..... 510/277 |
| 5,190,184 | A | * | 3/1993 | Lechner ..... 220/581 |
| 5,405,344 | A | | 4/1995 | Williamson et al. |
| 5,441,494 | A | | 8/1995 | Ortiz |
| 5,454,827 | A | | 10/1995 | Aust et al. |
| 5,502,981 | A | * | 4/1996 | Sullivan ..... 62/372 |
| 5,522,788 | A | | 6/1996 | Kuzmak |
| 5,683,732 | A | | 11/1997 | Baxter et al. |
| 5,704,898 | A | | 1/1998 | Kokish |
| 5,705,209 | A | | 1/1998 | Wright et al. |
| 5,714,186 | A | | 2/1998 | Nash et al. |
| 5,807,376 | A | | 9/1998 | Viola et al. |
| 5,810,716 | A | | 9/1998 | Mukherjee et al. |
| 5,897,840 | A | * | 4/1999 | Owens et al. ..... 422/559 |
| 6,200,311 | B1 | | 3/2001 | Danek et al. |
| 6,487,439 | B1 | | 11/2002 | Skladnev et al. |
| 6,584,800 | B1 | * | 7/2003 | Roth et al. ..... 62/457.3 |
| 6,913,627 | B2 | | 7/2005 | Matsuda |
| 7,082,784 | B2 | * | 8/2006 | Roth et al. ..... 62/457.2 |
| 7,614,513 | B2 | * | 11/2009 | Anderson ..... 215/10 |
| 7,669,726 | B2 | * | 3/2010 | Sun ..... 220/23.89 |
| 2002/0155199 | A1 | | 10/2002 | Heide et al. |
| 2004/0035867 | A1 | * | 2/2004 | Schultz et al. ..... 220/212 |
| 2006/0102581 | A1 | * | 5/2006 | Yates, III ..... 215/6 |
| 2006/0153956 | A1 | | 7/2006 | Ullmann |

FOREIGN PATENT DOCUMENTS

| | | | |
|---|---|---|---|
| DE | 201 06 836 | | 10/2001 |
| EP | 0227213 | | 7/1987 |
| EP | 0448200 | | 9/1991 |
| EP | 0520646 | | 12/1992 |
| EP | 0 536 906 | | 4/1993 |
| EP | 0597606 | | 5/1994 |
| EP | 0 668 836 | | 3/1995 |
| EP | 0673855 | | 9/1995 |
| EP | 0 941 296 | | 6/1998 |
| EP | 0934887 | | 8/1999 |
| EP | 0 965 536 | | 12/1999 |
| EP | 1055614 | | 11/2000 |
| EP | 1 073 593 | A | 2/2001 |
| EP | 1 251 079 | | 10/2002 |
| EP | 1 316 513 | | 6/2003 |
| GB | 2086834 | | 5/1982 |
| WO | WO 91/07326 | | 5/1991 |
| WO | WO 93/04945 | | 3/1993 |
| WO | WO 93/15973 | | 8/1993 |
| WO | WO 94/21533 | | 9/1994 |
| WO | 95/04688 | | 2/1995 |
| WO | WO 95/03982 | | 2/1995 |
| WO | WO 95/05325 | | 2/1995 |
| WO | WO 95/05326 | | 2/1995 |
| WO | WO 95/08493 | | 3/1995 |
| WO | WO 95/30603 | A | 11/1995 |
| WO | WO 96/38351 | | 12/1996 |
| WO | WO 97/00214 | | 1/1997 |
| WO | 98/23701 | | 6/1998 |
| WO | WO 99/54229 | | 10/1999 |
| WO | WO 00/17065 | | 3/2000 |
| WO | WO 00/69746 | | 11/2000 |

OTHER PUBLICATIONS

Official Action for U.S. Appl. No. 10/538,261, mailed Mar. 2, 2010.
Official Action for U.S. Appl. No. 10/538,261, mailed Dec. 22, 2010.
Official Action for U.S. Appl. No. 10/538,261, mailed Jun. 24, 2009.
Notice of Allowance for U.S. Appl. No. 10/538,261, mailed May 26, 2011 7 pages.

* cited by examiner

FLOATING MULTI-CHAMBERED INSERT FOR LIQUID CONTAINERS

The present invention relates to a multi-chamber container suitable as an insert for a pressurized fluid container, for example a beverage container (e.g., a beverage can). One chamber of this container is provided for storing an additive, which is supposed to remain separate from the fluid after the fluid container is filled and closed, but should be mixed into the fluid when the fluid container is opened, without requiring an additional external intervention in addition to the sudden decrease in pressure during opening.

A container of this type is known from EP 1 073 593. It has two chambers, namely a product chamber for the additive and a pressure chamber, and is formed of two parts which when joined create these two chambers. The pressure chamber is in communication with the environment via a small-sized opening in the sidewall, so that it has when the fluid container, e.g., a can, is opened, the same pressure as the main space of the can. When a consumer opens the can, a pressure difference is produced between the pressure chamber and the environment, the connection between the two parts of the two-chamber container suddenly opens, and the substances contained in the product chamber can be discharged into the interior space of the can. These can be any liquid or solid materials, e.g., vitamins, flavorings, food additives or dyes. This two-chamber container is typically secured on the bottom of a beverage container.

In many situations, it is desirable to secure a multi-chamber insert, such as the insert described above, not on the bottom or at another location, which is immersed in the liquid when the fluid container is in an upright position, but instead so that it can float freely in the fluid. Because the insert can then be fabricated at a separate location from the filling process of the can and provided with the desired additive. The insert is then thrown into the can at the end of the filling process, whereafter the can be immediately sealed without requiring any additional measures. If the multi-chamber insert is to be attached on the bottom of the can, then the can must either have corresponding attachment means, e.g., grooves for a snap-in connection, or one of the two two-chamber parts is attached in the can ahead of time, whereby depending on the geometry, this part or its counterpart is filled with the additive, and the two parts are finally connected with one another, whereby in the latter case that can has to be inverted. The can must then be inverted once more after it has been filled, so that the small-sized opening of the pressure chamber comes into contact with the gas space in the can for equilibrating the pressure.

The complex design of inserts attached in the can also requires additional logistic measures, in particular transport of the can between a different mounting and filling stations.

Attempts have been made in the past to produce a freely floating two-chamber insert, as described in EP 1 251 079 A1. To enable pressure equalization between the small-sized opening of the pressure chamber and the gas space in the fluid container, i.e., wherein this opening always points upward, it is proposed therein to provide the insert with a stable floating position, which is accomplished in that the insert has a constant cross-section over its length, while the center of area or a center of gravity axis or line is displaced to one side, whereby the small-sized opening is arranged in the exterior wall of the insert at a location which is farthest removed from the center of gravity. The inner chamber operating as the product chamber has a cylindrical shape, whereas the pressure chamber which surrounds the inner chamber in the axial direction, has a constant, but asymmetric cross-section. Both chambers are closed with a cover having an annular groove, with which the end of the wall of the product chamber engages when the inner container is closed. A snap-in closure is provided towards the exterior wall.

An inner container of the aforedescribed type has failed to operate satisfactorily. It is not a sufficient criteria for a floating insert that, due to the pressure difference, the cover is released from the exterior wall of the inner container at an arbitrary location when the fluid container is opened. Instead, the cover must reliably and reproducibly detach from the wall of the product chamber completely along the entire circumference and essentially be "blown away" by the gas pressure to provide a sufficiently large opening through which the additive can enter the fluid.

It is an object of the present invention to provide an inner container which is capable of accomplishing this.

The object is solved by a container with at least two chambers, which is provided as a free-floating inner container or as an insert for a pressurized fluid container and which includes a product chamber for receiving an additive and a pressure chamber with at least one opening oriented toward the outside with a small diameter (pressure equalization opening), wherein the geometry of the pressure chamber and the product chamber is selected so that the aforementioned opening is located above the fluid level when floating, the sidewalls of the two chambers are configured on their respective upper ends so that both chambers can be sealingly covered by a single cover, and that in a top view from the cover, the product chamber is laterally surrounded at least in a region proximate to the cover by the pressure chamber, characterized in that the cover includes sealing means which engage on each of the side walls of the two chambers at a constant distance from a respective wall end, and that a spacing (a) between a sealing line of the cover on the side wall of the pressure chamber and the end of this wall is greater than a spacing (b) between a sealing line of the cover on the side wall of the product chamber and the line in the region of the upper end of this product chamber sidewall, from which line on the seal no longer engages.

The term "sealing line between the cover and the sidewall of the pressure chamber" used above refers to the center of the seal or, if the seal is composed of several rings, the center of the seal which is farthest away from the outer edge.

The measure of the invention has the following effect: the main space of the fluid container is under an overpressure before the container is opened. The pressure chamber of the multi-chamber insert is in communication with its environment via a small-sized opening; the pressure chamber therefore has the same interior pressure as the main space after the fluid container is closed. During opening, for example for consuming the beverage contained in the container, the sudden pressure drop in the fluid container produces a pressure difference relative to the pressure chamber, which cannot decrease rapidly due to the small size of the aforementioned opening. The pressure in the pressure chamber, which is high compared to the surrounding pressure, pushes the cover from its original seat upward toward the end of the wall of the pressure chamber. Because the distance (a), over which the seal must travel along the exterior wall of the pressure chamber, until the seal reaches the upper end of the wall and no longer engages, is greater than the distance (b), over which the seal must travel therefor along the product chamber wall, the cover seal completely unblocks the product chamber, before the gas from the pressure chamber can escape between the wall and the cover.

The shape and diameter of the small-sized opening are known in the art.

The insert of the invention can be fabricated from any material. Advantageous are materials having a certain flexibility, preferred is the use of a plastic materials, such as polyethylene (DE) and polypropylene (PP).

It is important for full functionality of the insert that the opening with the reduced cross-section is arranged so as to be located in the head space, i.e., gas space of the surrounding package. This is particularly important during the time the package is being closed and about one minute thereafter, but also during temperature and pressure cycles in the later service life of the package. This is ensured by the present invention.

Advantageously, the seals between the cover and the walls of the product chamber and the pressure chamber are each disposed on the interior side of the walls. To this end, the cover may have corresponding steps. To keep the number of steps small and prevent the cover geometry from becoming unnecessarily complex, the product chamber wall advantageously extends upwardly less far than the exterior wall of the pressure chamber. The seal to the product chamber wall can be arranged, for example, on an extension of the cover oriented perpendicular to a relatively low interior level, which can jut upwardly if necessary, so that the cover can then continue in the cover plane until reaching the exterior wall of the pressure chamber. The cover is there again provided with an extension which is oriented perpendicular to the cover plane and supports the corresponding sealing means for the pressure chamber wall. The part of the cover extending outwardly therefrom can rest on the exterior wall of the pressure chamber.

In principle, it would also be possible to arrange the seals on the exterior sides of the respective sidewalls of the product and pressure chambers. However, the interior side is preferred because in this case, the contact pressure is enhanced by the increase of the hydrostatic pressure in the pressure chamber. Accordingly, such system is designed to be self-sealing.

Preferably, both seals have a circular periphery and, more particularly, are arranged concentric relative to one another. Circular seals do not "breathe" and are stable, because uniform pressure is applied from all directions. Seals with other shapes or cross sections are subjected to the applied pressure to different degrees, so that they tend to yield under the effect of the interior pressure at a location subjected to a particular high load, thereby potentially producing a premature, undesirable pressure equalization. If the seals are concentric to one another, then the pressure conditions are overall very uniform; the aforedescribed effect then occurs most reliably.

The circular shape of the seals presumes that the shape of both the product chamber and the pressure chamber is also circular at least at those locations where the cover is seated. For ease of fabrication, the product chamber advantageously has a cylindrical shape, with the cover covering an end face of the cylinder. Conical shapes are also feasible. If, in addition, concentrically arranged seals are to be implemented, then the pressure chamber may also be arranged symmetrically around the product chamber in the form of a tube. However, depending on the aspect ratio, the multi-chamber inserted may then come to rest in the fluid vertically, i.e., with an upward-pointing cover. The possibility that the additive enters the fluid after the cover is suddenly released following a pressure drop is relatively small, because all forces point symmetrically in the axial direction. It is therefore advantageous to shape the pressure chamber such that the center of gravity of the filled multi-chamber insert is not located in the longitudinal axis of the product chamber, but is displaced laterally so that the insert floats on the fluid at an angle of 30 to 60°. This can be realized, for example, by forming the pressure chamber asymmetric on the side facing away from the cover, although the pressure chamber is arranged around the product chamber concentrically with respect to the cover. One example is shown in FIG. 1. In the depicted multi-chamber insert, the product chamber has a cylindrical shape; however, the pressure chamber is not implemented on all sides of the pressure chamber. Due to its shape, it forms a kind of the swim bladder on one side of the insert. On that side, the opening with the small-sized diameter should be located. Adjacent is a sloped transition region where the asymmetric shape of the pressure chamber transitions continuously into a symmetric shape. The latter shape is implemented at least in the region where the seal between its exterior wall and the cover is located.

However, the design is not limited to these shapes. For example, the pressure chamber may exist all around the product chamber, albeit with a different thickness. The diameter of the pressure chamber could change all round, as viewed along its axial length, or only on one side (so-called 3-D freeforms). Also the (axial) height where the change begins could be the same around the periphery or different. It is also not required that the end face facing away from the cover is flat or planar, as shown in FIG. 1, and that the pressure chamber and the product chamber are flush with each other on this side. For example, the pressure chamber could instead surround the product chamber on the end face facing away from the cover and/or have a rounded shape. However, shapes similar to the illustrated shape are comparatively advantageous due to their ease of fabrication.

The sealing means of the cover are preferably implemented as peripheral bulges, such as lips, noses or other projections. Advantageous are snap-in seals, where a bulge on the cover engages with a groove in the corresponding sidewall, or so-called barrel-shaped seal seals, wherein one, two or possibly more protrusions with a rounded, "barrel-shaped-seal"-like shape press against a smooth wall or against a wall provided with corresponding grooves. They have a thickness preferably in a range of several tenths of a millimeter, for example about 0.1-0.6 mm. It has proven to be particularly advantageous to employ as a seal between the pressure chamber and the outside a sealing snap-in connection and/or for the seal of the product chamber a barrel-shaped seal, in particular a barrel-shaped seal with two barrel-shaped seals. These seal more reliably than only a single barrel-shaped seal, while it becomes more difficult to reliably obtain circumferential sealing lines with an arrangement of more than two barrel-shaped seals. The protrusion engaging in the recess of the snap-in connection can also be implemented in the shape of a barrel-shaped seal.

In particular, when using the aforementioned barrel-shaped seal seals for the product chamber (but not in this case alone), it is most advantageous if the diameter of the inner part of the cover, including the sealing means, in this case the barrel-shaped seals, sealing the product chamber, ($d_3$), is greater than the unobstructed width of the product chamber (d−i), because in this way a press fit of the cover with particularly good sealing characteristic is obtained. This can be realized in particular when employing inserts made of PE/PP.

The sealing ability is further increased by disposing between the two barrel-shaped seals a hydrophobic liquid, e.g., oil.

In a particularly advantageous embodiment of the invention, the product chamber wall terminates in a inwardly rounded shape towards the cover. It is particularly desirable if the rounded portion thins the wall approximately in a range (g) which corresponds, for example, approximately to the material thickness of the wall (t). In this case, the sealing line has a spacing (b) to the start of the region (g) in the center of the only seal or of the seal which is farthest away from the outer edge. Moreover, in this or in another particular embodiment, the upper end of the wall of this product chamber wall can have a relatively small spacing (c) to the part of the cover with protrudes outwardly over the upper end. One or the other of the two particular embodiments can also be combined with the aforedescribed measure wherein two barrel-shaped seals are employed as a seal for the product chamber. The sealing line of the lower barrel-shaped seal then has a spacing (b) from the beginning of the region (g). If all three aforementioned embodiments are implemented in combination, then the seal of the product chamber is completely released when the inner barrel-shaped seal is displaced by a distance d−(g+c). In this case, according to the invention, a>d−(g+c), whereby d−(g+c)=c. If the cover is instead firmly pressed against the lower part, for example by a hydrostatic pressure, then c=0, so that the lower barrel-shaped seal must move by d−g=b. Following this axial movement of the cover in the lower portion, the lower barrel-shaped seal reaches the rounded region of the product chamber wall. This point must be reached before the seal which seals the outer pressure chamber, is to be released (i.e., a>d−g). If the aforementioned conditions are not satisfied, then pressure can escape from the gap between the cover and the lower section, while the cover is still guided through the product chamber seal. The cover will then get stuck in the region of the product chamber seal, which prevents the fill material in the product chamber from reaching the surrounding fluid.

An exemplary embodiment of the invention will now be described again with respect to the figures.

Figure 1A:
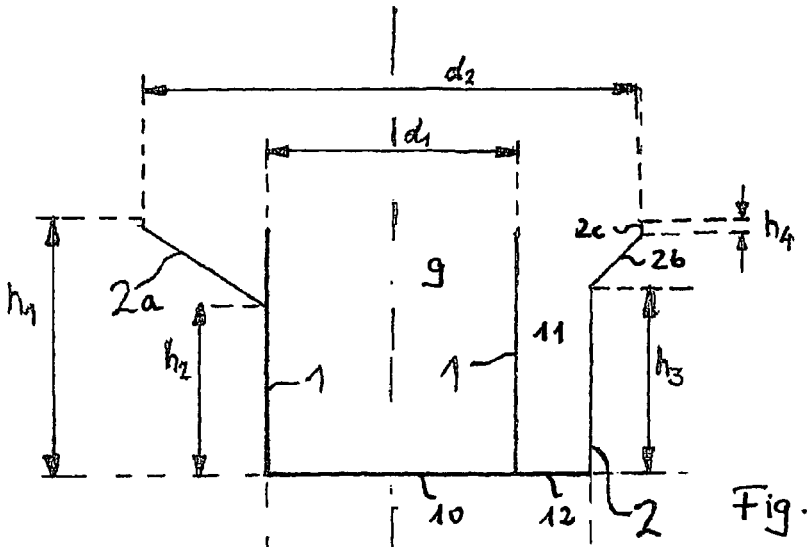
FIG. 1A is a side view of the insert.
Figure 1B:
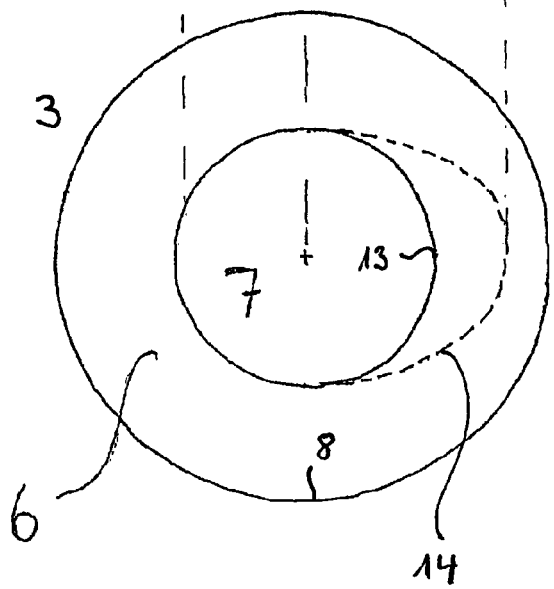
FIG. 1B is a top view of the insert.

FIG. 1 shows the geometry of an insert, wherein both seals 8, 13 have a circular and concentric shape. Figure A shows the geometry from the side, whereas Figure B illustrates the geometry in a top view. A cylindrical product chamber 9 has a bottom 10 and a sidewall 1. The pressure chamber 11 is bounded by the bottom 12, by the inner sidewall 1 and by the outer sidewalls 2, 2*a*, 2*b*, 2*c*. The cover 3 closes with its part 7 the cylindrical product chamber, and with its part 6 the pressure chamber 11. In the lower region of the insert, which faces away from the cover, the pressure chamber is implemented over a length h2 only on one side of the pressure chamber (wall 2), forming a kind of swim bladder. The opening with the reduced cross-section (not shown) is also disposed on this side. In the top view (FIG. 1B), the outline of the bottom of the product chamber is indicated as circular line 7, whereas the bottom outline of the exterior wall of the pressure chamber is indicated as partially dashed line 14. In a center region, the sidewall (2*b*) of the pressure chamber then extends from the height h3 outwardly with a slop; on the opposite side, the outer wall 2*a* starts on the wall 1 at the same height h2 and is also outwardly sloped, but with a steeper angle. Both wall sections terminate in an axial region 2*c* which is arranged circularly and concentrically with respect to the interior wall 1. This region must have a length of at least h4 greater than a (which is the spacing of the sealing line between the cover and the lateral outer wall 2*c* from the end of this exterior wall, see description). The total height of the sidewalls 2, 2*a*/2*b*, 2*c* is indicated with h1. Those skilled in the art will understand that h2 and h3 need not necessarily be equal; they can also be different, whereby the slopes of the walls 2*a*, 2*b* must then be adapted accordingly.

The inside diameter of the product chamber has a constant value d1 over its entire axial length, the inside diameter of the exterior walls 2*c* which are circular at their respective ends facing the cover has the value d2.

Figure 2:
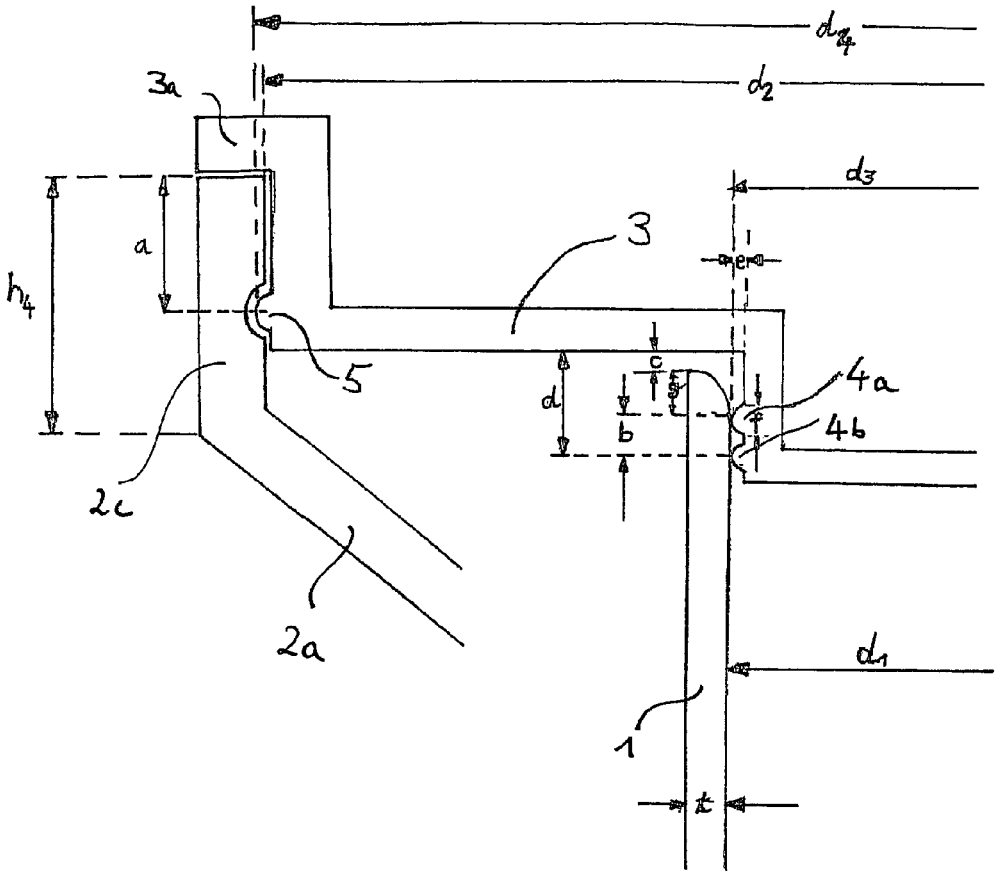
FIG. 2 is a side view of the seals.

FIG. 2 illustrates the geometric relationships of the seals. The wall 1 of the product chamber with the wall thickness (t) is a rounded at the edge facing the cover, such that the rounded portion thins the wall in a region over a length (g) which corresponds approximately to the material thickness (t). It has a lesser height than the pressure chamber wall and is selected so that the cover can have a spacing (c) from the wall different from the zero (however, this need not be the case). The cover 3 contacts the inside of the product chamber wall 1 in the region of the seal which is made of barrel-shaped seals 4*a*, 4*b*. The barrel-shaped seals have along their periphery a width (f) and a thickness (e)<(f). The inner part of the cover, including the sealing means (the barrel-shaped seals), has a diameter d3, the diameter of the product chamber is indicated with d1. For d3>d1, the cover makes contact with a press fit.

A circumferential groove, in which a snap-in barrel-shaped seal 5 sealingly engages, is disposed in the upper exterior wall 2*c* of the pressure chamber below the upper end of the wall 2*c*. The groove is arranged with a spacing (a) from the upper end of the wall; the most outward portion 3*a* of the cover rests on the groove. The exterior wall 2*c* is coaxial with the product sidewall at least in a region h4 which is a greater than the spacing (a), i.e., the spacing between the cover seal 5 and the sidewall of the pressure chamber 2*c* from the end of this wall.

When an external pressure is applied to the system, the inner seal is already adequate to withstand small pressures (<1 bar) due to the two barrel-shaped seals 4*a*, 4*b*. The cover is thereby pressed into the lower part to firmly contact the end of the product chamber wall. The system is capable of withstanding pressures up to several bars.

During opening (under a pressure difference between the pressure chamber and the outer environment) the cover moves away from the lower part as far as possible. The seal of the product chamber is then completely released, when the inner barrel-shaped seal has moved a distance b=d−(g+c). If the cover is firmly pressed against the lower part by a hydrostatic pressure and is not obstructed by the outer cover edge 3*a*, then c=0, so that the lower barrel-shaped seal must move by b=d−g. Following this axial motion of the cover in the lower part, the lower barrel-shaped seal reaches the rounded region of the product chamber wall. This point must be reached before the snap-in barrel-shaped seal 5 is released. Moreover, in this exemplary embodiment, it is necessary that a>d−(g+c) and also a>b, independent of the specific design of the product chamber seal.

The figure also shows that the seal between the cover on the exterior wall of the pressure chamber has a press fit when the diameter of the cover including sealing means (snap-in barrel-shaped seal), d4, is greater than the inside diameter d2 of the product chamber facing the cover.

The invention claimed is:

1. An insert for a pressurized fluid container comprising a product chamber for receiving an additive, said product chamber being laterally surrounded by a pressure chamber in at least a region of the pressure chamber proximate to a cover, the pressure chamber having an opening oriented toward the outside of the pressure chamber, said opening being located above the fluid level of the pressurized fluid container when the fluid container contains fluid and the insert is floating in the fluid container, the cover for closing the product and pressure chambers, said cover including seals which engage side walls of the pressure and product chambers at a constant distance from a respective side wall end, said engagement creating a sealing line on the side wall of the pressure chamber and a sealing line on the side wall of the product chamber, wherein a first distance between the sealing line on the side wall of the pressure chamber and the pressure chamber side wall end is greater than a second distance between the sealing line on the side wall of the product chamber and the product chamber side wall end, wherein the seals between the cover and the product chamber wall and between the cover and an exterior wall of the pressure chamber extend in a circular fashion at a substantially constant height around the respective walls, and wherein the product chamber and the pressure chamber are fixed to each other so they maintain a relatively fixed geometrical position.

2. An insert according to claim 1, wherein the seals which engage side walls of the pressure and product chambers are disposed on an interior of the side walls of the pressure and product chambers.

3. An insert according to claim 1, wherein the seals are arranged concentrically with respect to one another.

4. An insert according to claim 1, wherein the seals comprise circumferential bulges.

5. An insert according to claim 4, wherein the seal between the cover and the exterior wall of the pressure chamber engages with a groove disposed in the exterior wall of the pressure chamber.

6. An insert according to claim 4, wherein the seal(s) between the cover and the product chamber wall are one or two circumferential barrel-shaped seals, between which a sealing fluid is disposed.

7. An insert according to claim 1, wherein the product chamber wall has a region denoted by an inwardly rounded shape projecting towards the cover, wherein the spacing between the sealing line of the cover on the side wall of the pressure chamber and the end of the wall is greater than the sum of (a) the spacing between a sealing line of the cover on the side wall of the product chamber and a line in the region of the upper end of the product chamber sidewall no longer engaged by the seal, and (b) the region denoted by the inwardly rounded shape.

8. An insert according to claim 7, wherein the length of the region denoted by the inwardly rounded shape is approximately equal to the thickness of the product chamber wall.

9. An insert according to claim 7, wherein a spacing exists between the end of the product chamber wall and the cover.

10. An insert according to claim 9, wherein the spacing between the sealing line of the cover on the side wall of the pressure chamber and the end of the wall is greater than the sum of (a) the spacing between a sealing line of the cover on the side wall of the product chamber and a line in the region of the upper end of the product chamber sidewall no longer engaged by the seal, (b) the region denoted by the inwardly rounded shape, and (c) the spacing between the product cover wall and the cover.

11. An insert according to claim 1 wherein the product chamber is filled with an additive.

12. A fluid container comprising a fluid and floating thereon an insert according to claim 1.

13. The fluid container according to claim 12 which is a beverage can.

14. An insert for a pressurized fluid container comprising a product chamber for receiving an additive, said product chamber being laterally surrounded by a pressure chamber in at least a region of the pressure chamber proximate to a cover, the pressure chamber having an opening oriented toward the outside of the pressure chamber, said opening being located above the fluid level of the pressurized fluid container when the fluid container contains fluid and the insert is floating in the fluid container, the cover for closing the product and pressure chambers, said cover comprising one or more circumferential sealing members engaging a side wall of the pressure chamber and one or more circumferential sealing members engaging a side wall of the product chamber, said circumferential sealing members creating at least one seal between said cover and said side wall of the pressure chamber and at least one seal between said cover and side wall of the product chamber when the insert is in a closed position, wherein said seals extend in a circular fashion at a constant height around the respective walls, and wherein during axial movement of the cover, the at least one seal between said cap and said side wall of said product chamber is disengaged upon moving the cap a first axial distance, and the at least one seal between said cap and said side wall of said pressure chamber is disengaged upon moving the cap a second axial distance, said second axial distance being greater than said first axial distance.

* * * * *